US011787229B1

(12) United States Patent
Injun

(10) Patent No.: US 11,787,229 B1
(45) Date of Patent: Oct. 17, 2023

(54) PAINT STORAGE ASSEMBLY

(71) Applicant: Wuttikai Injun, Lubbock, TX (US)

(72) Inventor: Wuttikai Injun, Lubbock, TX (US)

( * ) Notice: Subject to any disclaimer, the term of this patent is extended or adjusted under 35 U.S.C. 154(b) by 0 days.

(21) Appl. No.: 17/881,332

(22) Filed: Aug. 4, 2022

(51) Int. Cl.
*B44D 3/12* (2006.01)
*B65D 81/24* (2006.01)

(52) U.S. Cl.
CPC ..... *B44D 3/125* (2013.01)

(58) Field of Classification Search
CPC ..... B44D 3/125; B65D 81/22; B65D 81/24
USPC ..... 206/209, 209.1, 217, 361, 362.1, 362.2, 206/362.3, 15.2, 15.3
See application file for complete search history.

(56) References Cited

U.S. PATENT DOCUMENTS 1,687,179 A * 10/1928 Peterson ..... B65D 51/32 220/736
2,744,635 A * 5/1956 Hiss ..... B44D 3/125 248/113
4,771,501 A * 9/1988 Leiter ..... B44D 3/121 401/121
6,871,825 B2 3/2005 Song
7,383,948 B1 * 6/2008 Richardson ..... B44D 3/006 206/229
8,887,940 B2 11/2014 Kiceniuk, Jr. et al.
9,102,193 B1 8/2015 Mahowald
2004/0261819 A1 * 12/2004 Farnoush ..... B44D 3/125 15/257.01
2007/0170079 A1 7/2007 Gangemi
2012/0193251 A1 8/2012 Rittmann

FOREIGN PATENT DOCUMENTS

WO WO2016149791 9/2016

* cited by examiner

*Primary Examiner* — Luan K Bui

(57) ABSTRACT

A paint storage assembly for temporarily storing a wet paint brush includes a cup for containing liquid paint. A clip is attached to the cup and the clip releasably engages a paint brush for storing the paint brush. A cover is hingedly disposed on the cup and the cover is positionable in a closed position to enclose the paint brush thereby inhibiting the paint brush from drying out. The cover is positionable in an open position to facilitate the paint brush to be removed from the clip.

9 Claims, 8 Drawing Sheets

PAINT STORAGE ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to storage devices and more particularly pertains to a new storage device for temporarily storing a wet paint brush. The device includes a cup for storing liquid paint and a clip attached to the cup which engages a wet paint brush. The device includes a cover hingedly coupled to the cup which encloses the wet paint brush when the cover is closed. The device includes a cover hingedly disposed on the cup which encloses a head of the wet paint brush when the cover is closed to inhibit the wet paint brush from drying out.

(2) Description of Related Art Including Information Disclosed Under 37 CFR 1.97 and 1.98

The prior art relates to storage devices including a paint clip that is attachable to a lip of paint can and which includes fingers that engage a handle of a paint brush for hanging the paint brush in the paint can. The prior art discloses paint bucket for storing painting tools. The prior art discloses a slightly tapered annular ring which has brushes. The prior art discloses a paint brush housing comprising a lower portion and an upper portion for enclosing a paint brush. The prior art discloses a paint bucket which has a sloped grip for carrying the paint bucket. The prior art discloses a modular paint brush container for storing a wet paint brush.

(h) BRIEF SUMMARY OF THE INVENTION

An embodiment of the disclosure meets the needs presented above by generally comprising a cup for containing liquid paint. A clip is attached to the cup and the clip releasably engages a paint brush for storing the paint brush.

A cover is hingedly disposed on the cup and the cover is positionable in a closed position to enclose the paint brush thereby inhibiting the paint brush from drying out. The cover is positionable in an open position to facilitate the paint brush to be removed from the clip.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
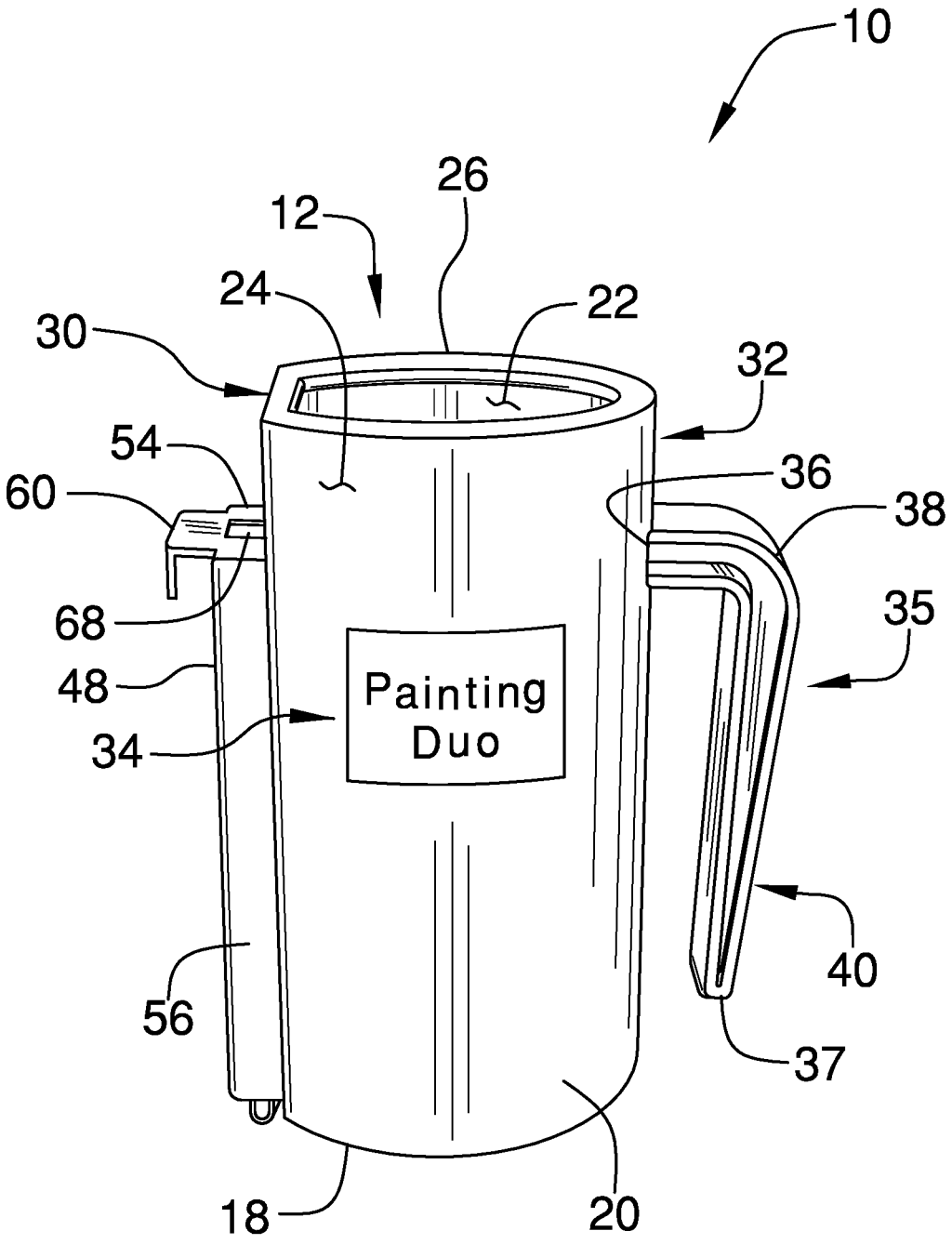
FIG. 1 is a perspective view of a paint storage assembly according to an embodiment of the disclosure.
Figure 2:
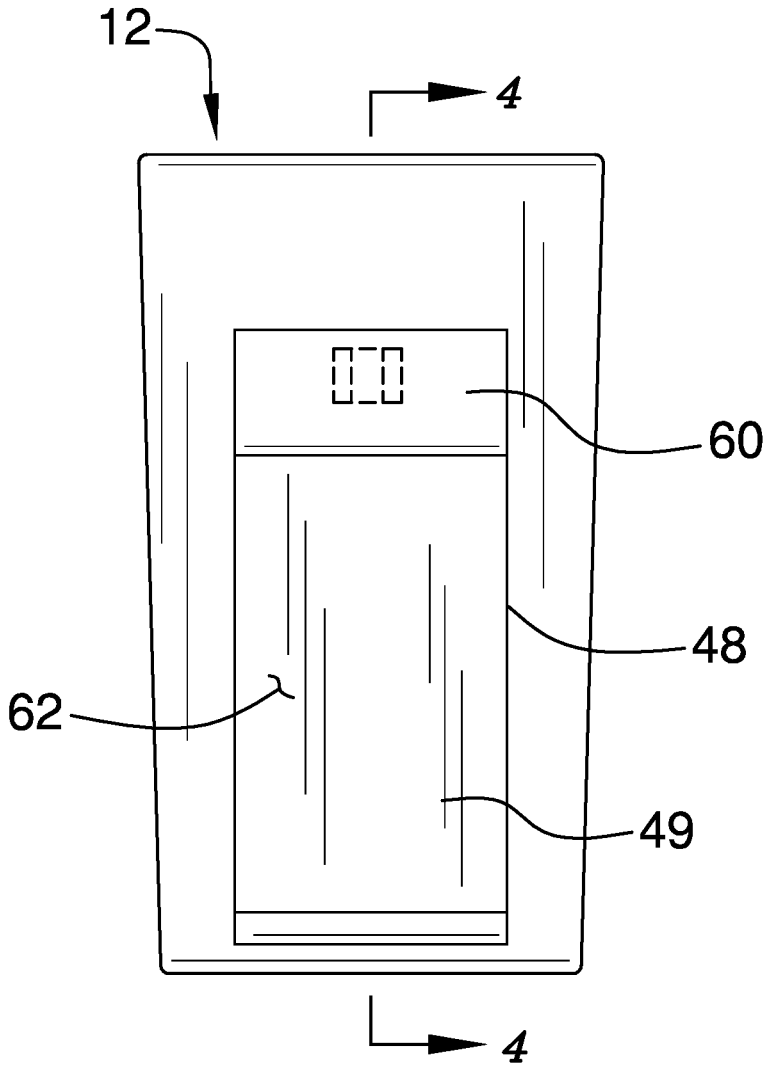
FIG. 2 is a front phantom view of an embodiment of the disclosure.
Figure 3:
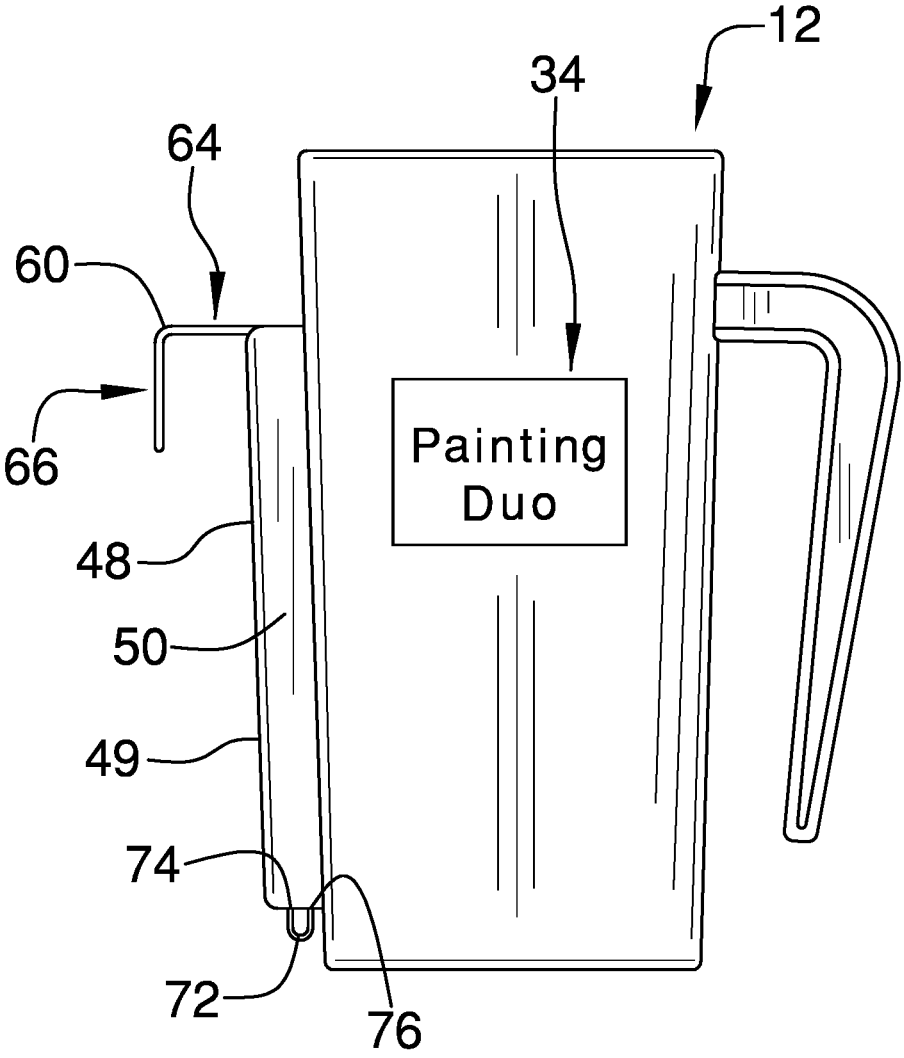
FIG. 3 is a left side view of an embodiment of the disclosure.
Figure 4:
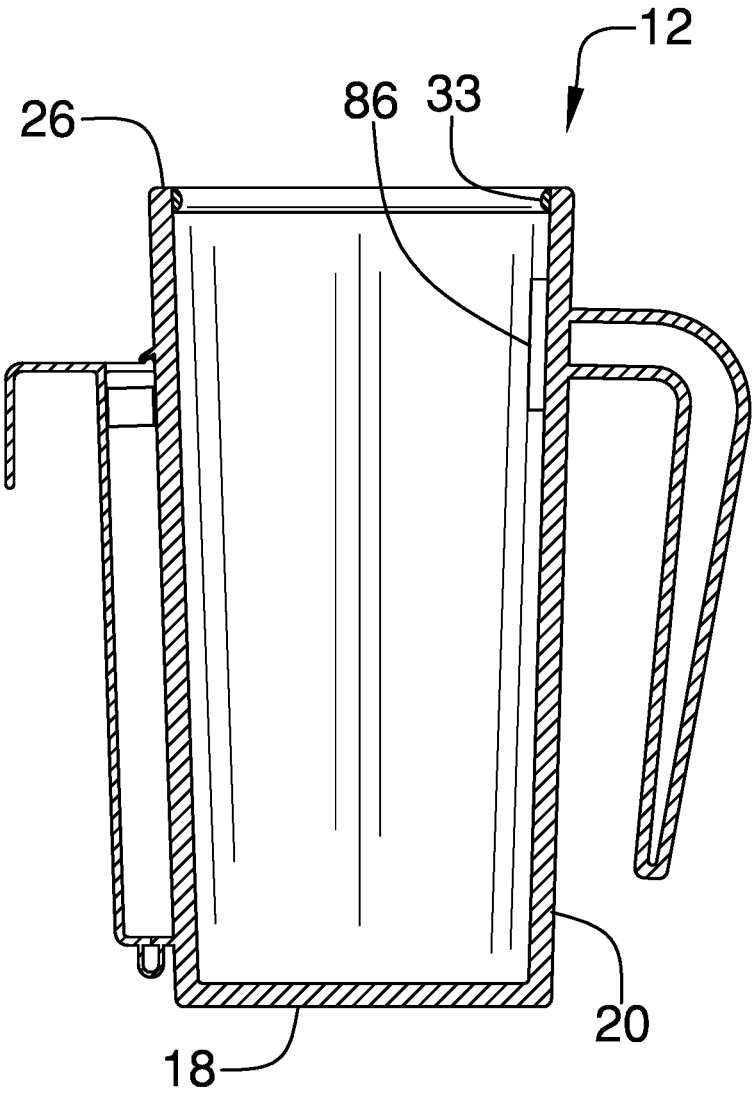
FIG. 4 is a cross section view taken along line 4-4 of FIG. 2 of an embodiment of the disclosure.
Figure 5:
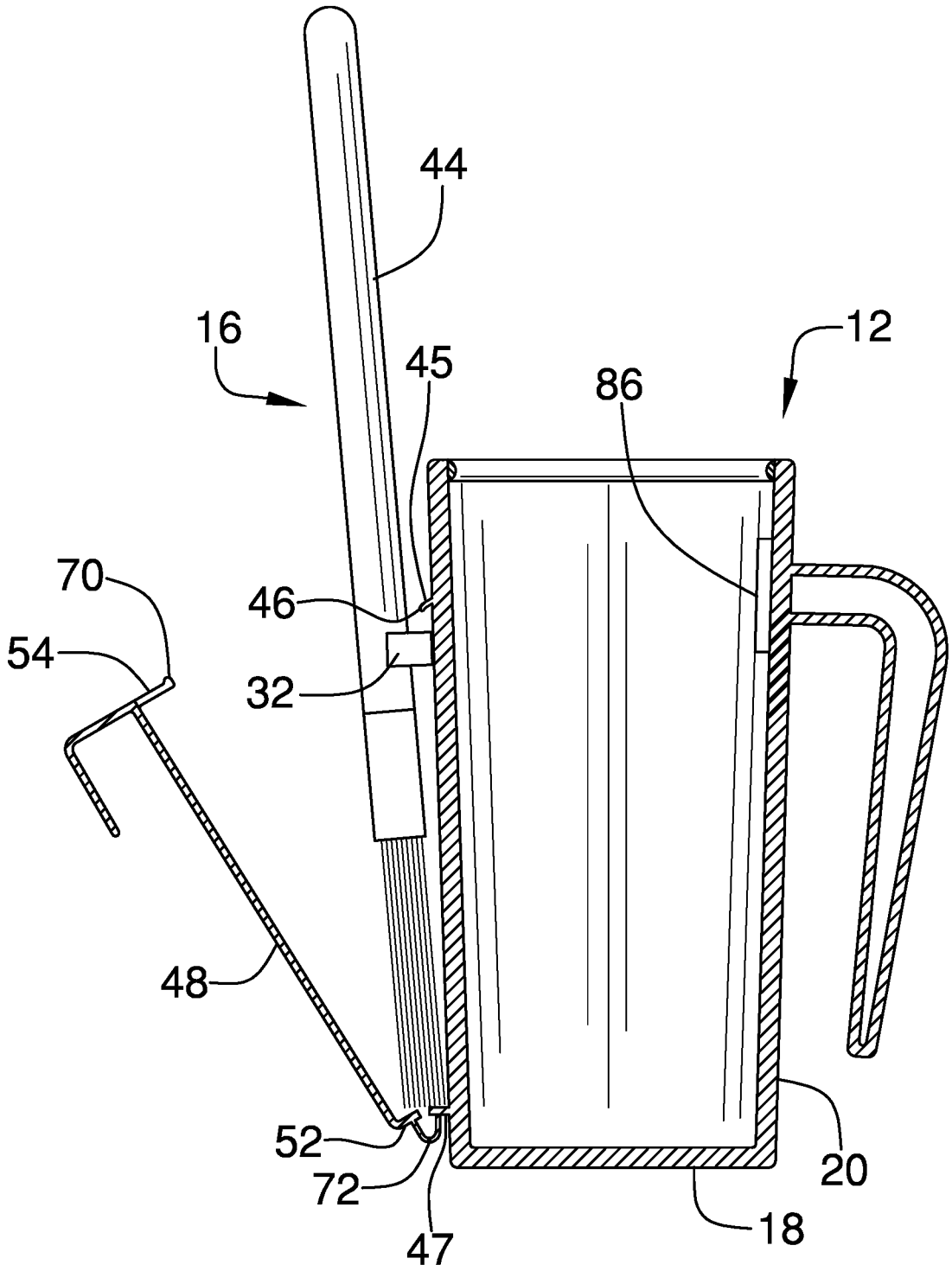
FIG. 5 is a cross sectional view taken along line 4-4 of FIG. 2 of an embodiment of the disclosure showing a paint brush being coupled to a clip.
Figure 6:
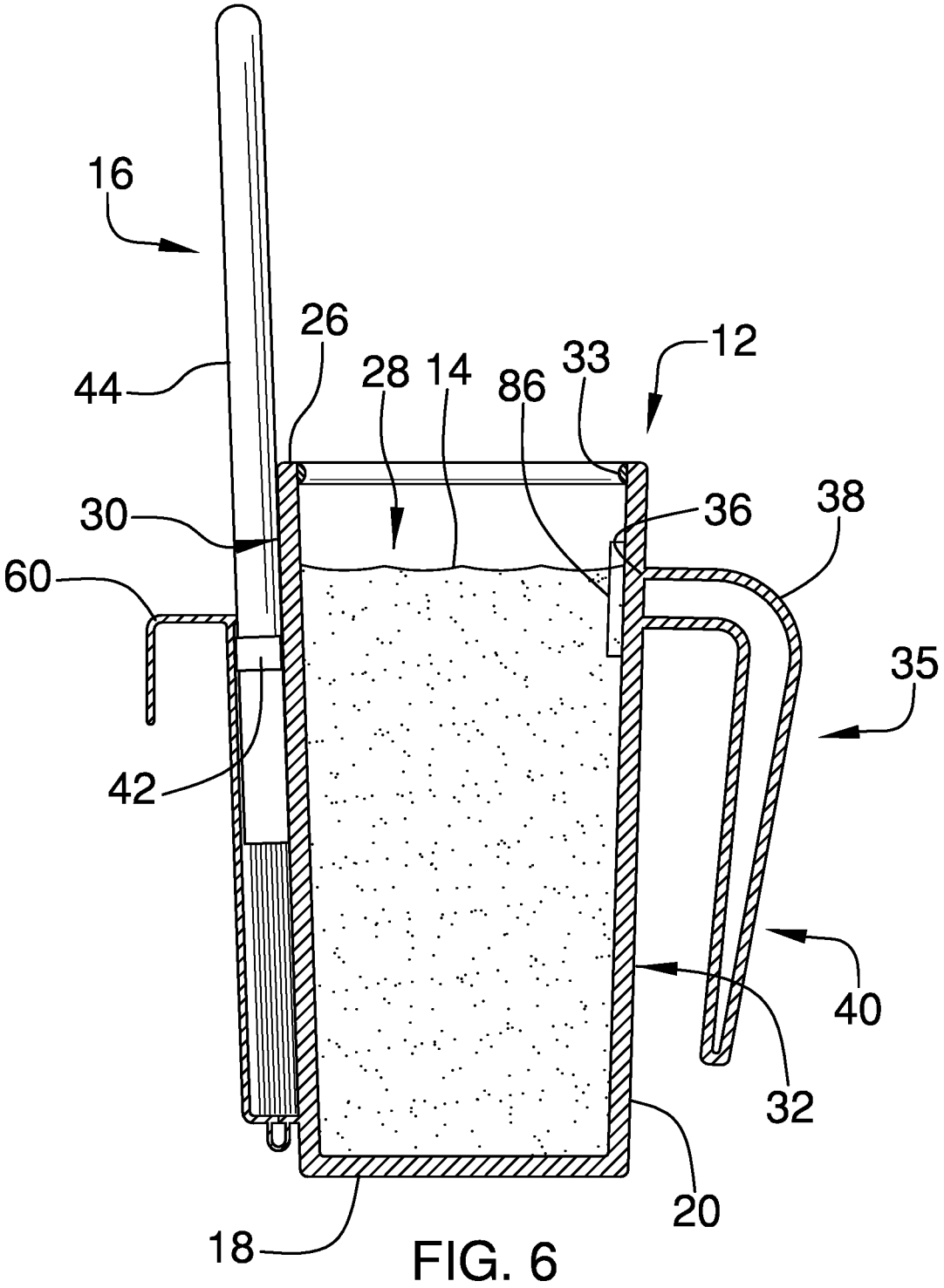
FIG. 6 is a cross sectional view taken along line 4-4 of FIG. 2 of an embodiment of the disclosure showing a cover being closed around a paint brush.
Figure 7:
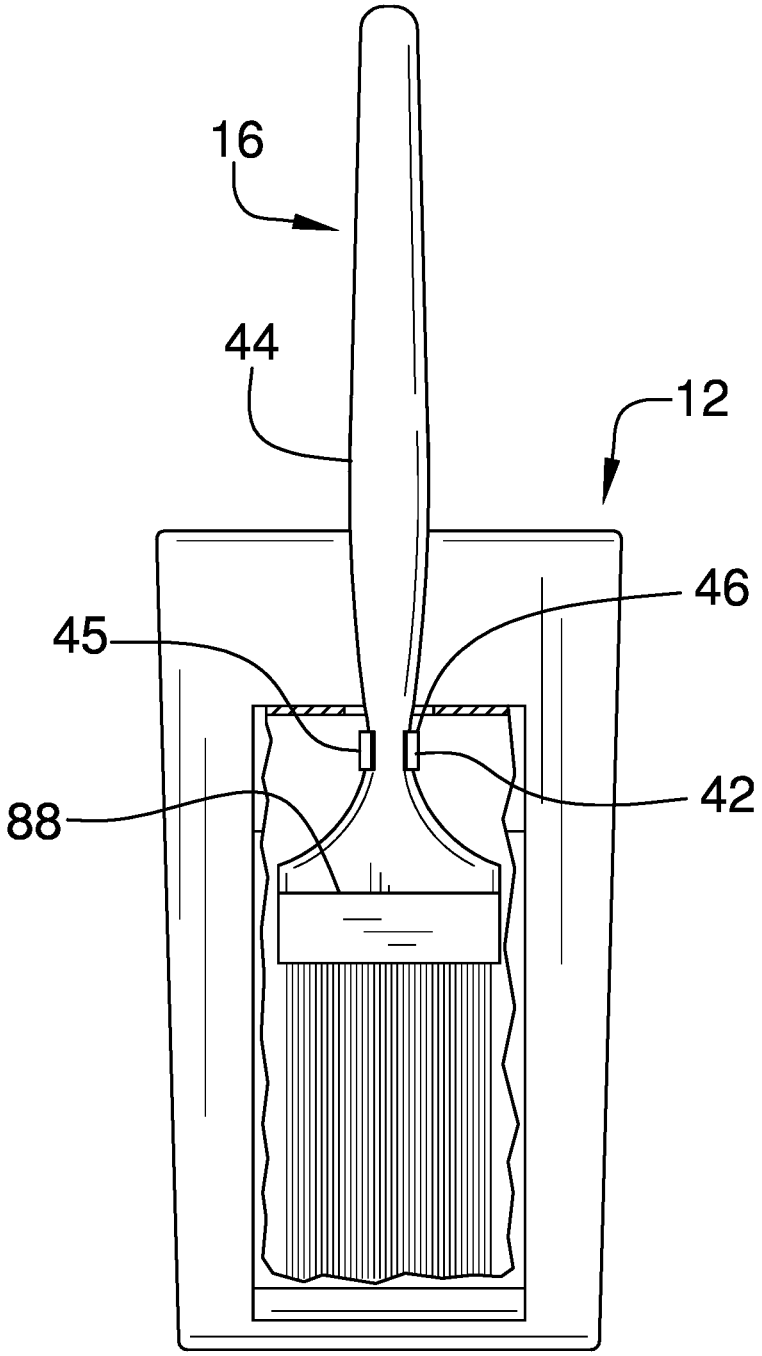
FIG. 7 is a front cut-away view of an embodiment of the disclosure.
Figure 8:
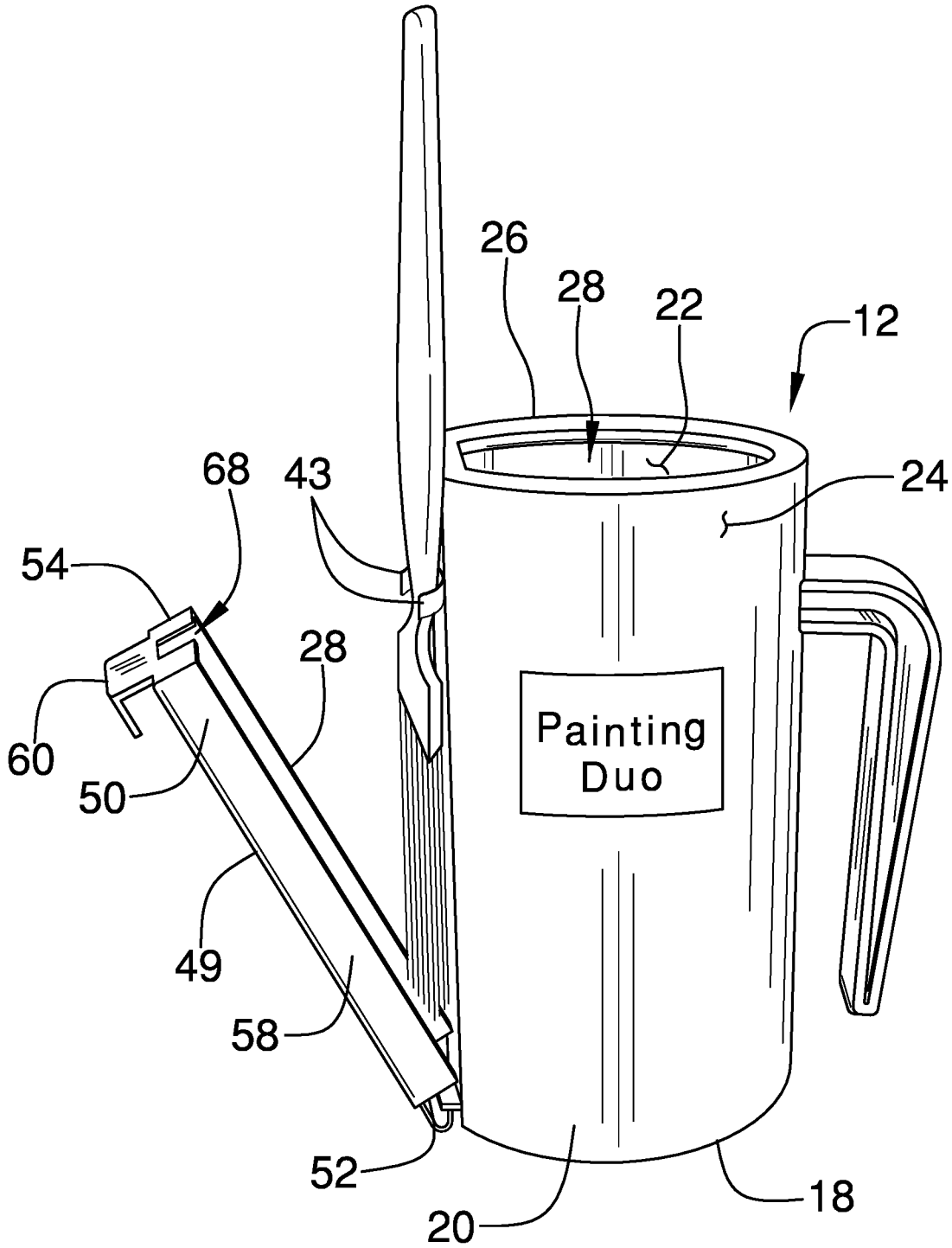
FIG. 8 is a perspective in-use view of an embodiment of the disclosure.

With reference now to the drawings, and in particular to FIGS. 1 through 8 thereof, a new storage device embodying the principles and concepts of an embodiment of the disclosure and generally designated by the reference numeral 10 will be described.

As best illustrated in FIGS. 1 through 8, the paint storage assembly 10 generally comprises a cup 12 for containing a liquid paint 14. The liquid paint 14 may be latex interior paint, for example, or other type of liquid paint that would commonly be applied to surface with a paint brush 16. The cup 12 has a bottom wall 18 and an outer wall 20 extending upwardly from the bottom wall 18, and the outer wall 20 has an inside surface 22, an outside surface 24 and a distal end 26 with respect to the bottom wall 18 defining an opening 28 into the cup 12. The outer wall 20 has a first side 30 and a second side 32; the first side 30 is planar and the inside surface 22 corresponding to the second side 32 is concavely arcuate with respect to the first side 30.

The outer wall 20 has a lip 33 that is disposed on the inside surface 22 and the lip 33 is aligned with the distal end 26 of the outer wall 20. Furthermore, the lip 33 is rounded with respect to the inside surface 22 and the lip 33 extends around a full perimeter of the distal end 26. Indicia 34 are applied on the outside surface 24 of the outer wall 20 and the indicia 34 comprise the words "Painting Duo". The indicia 34 may be applied on the outer wall 20 in a variety of ways, including but not being limited to, a decal that is adhered to the outer wall 20 or printing that is printed on the outer wall 20. The cup 12 may have a depth ranging between 3.0 cm and 5.0 cm and a width ranging between 2.0 cm and 3.0 cm.

A handle 35 is coupled to the cup 12 for carrying the cup 12, the handle 35 has a first end 36 and a second end 37, and the first end 36 is coupled to the outside surface 24 of the outer wall 20 of the cup 12. The handle 35 is positioned on the second side 32 of the outer wall 20 at a point located directly opposite the first side 30 of the outer wall 20. The handle 35 has a bend 38 that is positioned closer to the first end 36 than the second end 37 to define a grip portion 40 of the handle 35 which is spaced from and extends downwardly along the outer wall 20 of the cup 12. The grip portion 40 tapers between the bend 38 and the second end 37.

A clip 42 is coupled to the outside surface 24 of the outer wall 20 of the cup 12 and the clip 42 is positioned on the first side 30 of the outer wall 20. The clip 42 has a pair of members 43 that are spaced apart from each other an appropriate distance to receive a handle 44 of a paint brush 16 thereby attaching the paint brush 16 to the cup 12. Each of the members 36 may be biased toward each other for gripping the handle 44 of the paint brush 16. The paint brush 16 is oriented to extend along a vertical axis with the bristles 41 being directed toward the bottom wall 18 of the cup when the handle 44 is engaged in the clip 42.

An engagement 45 is coupled to the outside surface 24 of the outer wall 20 of the cup 12 and the engagement 45 has a distal end 46 with respect to the outside surface 24. The engagement 45 curves downwardly between the outer wall 20 the distal end 46 of the engagement 45 and the engagement 45 is positioned above the clip 42 on the first side 30 of the outer wall 20. A tab 47 is coupled to and extends away from the outside surface 24 of the outer wall 20 of the cup 12. The tab 47 is positioned on the first side 30 of the outer wall 20 and the tab 47 is spaced from the bottom wall 18 of the cup 12.

A cover 48 is provided and the cover 48 is hingedly disposed on the cup 12. The cover 48 is positionable in a closed position having the cover 48 enclosing the paint brush 16 when the paint brush 16 is attached to the clip 42. In this way the cover 48 inhibits the paint brush 16 from drying out. Conversely, the cover 48 is positionable in an open position having the cover 48 exposing the paint brush 16 when the paint brush 16 is attached to the clip 42. In this way the cover 48 facilitates the paint brush 16 to be removed from the clip 42.

The cover 48 has a front wall 49 and an exterior wall 50 extending away from the front wall 49; the exterior wall 50 has a lower side 52, a top side 54, a first lateral side 56 and a second lateral side 58. The cover 48 has a grip 60 extending laterally away from a forward surface 62 of the front wall 49 and the grip 60 is aligned with the top side 54. The grip 60 has a first portion 64 lying on a plane that is oriented coplanar with the top side 54. Furthermore, the grip 60 has a second portion 66 that is spaced from and extends downwardly along the front wall 49 thereby facilitating the second portion 66 to be gripped for urging the cover 48 into the open position.

The top side 54 has a notch 68 extending toward the front wall 49 to accommodate the handle 44 of the paint brush 16 when the cover 48 is positioned in the closed position. The top side 54 has a prominence 70 extending away from a top surface 72 of the top side 54. The engagement 45 releasably engages the prominence 70 when cover 48 is positioned in the closed position for retaining the cover 48 in the closed position. A hinge 72 is included that has a primary end 74 and a secondary end 76, and the primary end 74 is coupled to a lower surface 78 of the lower side 52 of the cover 48. The secondary end 76 is coupled to a lower surface 80 of the tab 47 on the outer wall 20 of the cup 12. Furthermore, the hinge 72 is comprised of a deformable material and a distal edge 82 of the lower side 52 of the cover 48 abuts a distal edge 84 of the tab 47 on the outer wall 20 of the cup 12 when the cover 48 is closed.

A magnet 86 is integrated into the cup 12 thereby facilitating the magnet 86 to magnetically engage a ferrule 88 of the paint brush 16. In this way the paint brush 16 can be temporarily stored during a short break. The magnet 86 is integrated into the inside surface 22 of the outer wall 20 of the cup 12 and the magnet 86 is aligned with the first end 36 of the handle 35. In this way the handle 44 of the paint brush 16 is directed upwardly beyond the lip 33 of the outer wall 20 when the magnet 86 is supporting the paint brush 16.

In use, the liquid paint 14 is poured into the cup 12, the paint brush 16 is stored in the clip 42 and the cover 48 is closed to enclose the paint brush 16. In this way the paint brush 16 can be temporarily stored when the paint brush 16 is wet with liquid paint 14. The cover 48 is opened to remove the paint brush 16 from the clip 42 for employing the paint brush 16. Thus, the paint brush 16 does not have to be cleaned in between painting sessions. The paint brush 16 can be cleaned when the painting project is completed and the liquid paint 14 can be emptied from the cup 12 when the painting project is completed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paint storage assembly for storing liquid paint and for temporarily storing a paint brush to inhibit the paint brush from drying out, said assembly comprising:

a cup for containing liquid paint;

a handle being coupled to said cup for carrying said cup;

a clip being attached to said cup, said clip releasably engaging a paint brush for storing the paint brush;

a cover being hingedly disposed on said cup, said cover being positionable in a closed position having said cover enclosing the paint brush when the paint brush is attached to said clip wherein said cover is configured to inhibit the paint brush from drying out, said cover being positionable in an open position having said cover exposing the paint brush when the paint brush is attached to said clip wherein said cover is configured to facilitate the paint brush to be removed from said clip;

wherein said cup has a bottom wall and an outer wall extending upwardly from said bottom wall, said outer wall having an inside surface, an outside surface and a distal end with respect to said bottom wall defining an opening into said cup;

wherein said outer wall has a first side and a second side, said first side being planar, said inner surface corresponding to said second side being concavely arcuate with respect to said first side;

wherein said outer wall has a lip being disposed on said inner surface, said lip being aligned with said distal end of said outer wall, said lip being rounded with respect to said inner surface, said lip extending around a full perimeter of said distal end; and wherein said second side of said outer wall has indicia being applied thereon, said indicia comprising the words "Painting Duo".

2. The assembly according to claim 1, wherein said handle has a first end and a second end, said first end being coupled to said outer surface of said outer wall of said cup, said handle being positioned on said second side of said outer wall at a point located directly opposite said first side of said outer wall, said handle having a bend being positioned closer to said first end than said second end to define a grip portion of said handle being spaced from and extending downwardly along said outer wall of said cup, said grip portion tapering between said bend and said second end.

3. The assembly according to claim 1, wherein said clip is coupled to said outer surface of said outer wall of said cup, said clip being positioned on said first side of said outer wall, said clip having a pair of members being spaced apart from each other an appropriate distance to receive a handle of a paint brush thereby attaching the paint brush to said cup.

4. The assembly according to claim 3, further comprising an engagement being coupled to said outer surface of said outer wall of said cup, said engagement having a distal end with respect to said outer surface, said engagement curving downwardly between said outer wall said distal end of said engagement, said engagement being positioned above said clip on said first side of said outer wall.

5. The assembly according to claim 1, further comprising a magnet being integrated into said cup thereby facilitating said magnet to magnetically engage a ferrule of the paint brush to temporarily store the paint brush, said magnet being integrated into said inside surface of said outer wall of said cup, said magnet being aligned with said first end of said handle.

6. A paint storage assembly for storing liquid paint and for temporarily storing a paint brush to inhibit the paint brush from drying out, said assembly comprising:

a cup for containing liquid paint;

a handle being coupled to said cup for carrying said cup;

a clip being attached to said cup, said clip releasably engaging a paint brush for storing the paint brush;

a cover being hingedly disposed on said cup, said cover being positionable in a closed position having said cover enclosing the paint brush when the paint brush is attached to said clip Wherein said cover is configured to inhibit the paint brush from drying out, said cover being positionable in an open position having said cover exposing the paint brush when the paint brush is attached to said clip wherein said cover is configured to facilitate the paint brush to be removed from said clip;

wherein said cover has a front wall and an exterior wall extending away from said front wall, said exterior wall having a lower side, a top side, a first lateral side and a second lateral side;

wherein said cover has a grip extending laterally away from a forward surface of said front wall, said grip being aligned with said top side, said grip having a first portion lying on a plane being oriented coplanar with said top side and a second portion being spaced from and extending downwardly along said front wall thereby facilitating said second portion to be gripped for urging said cover into said open position; and wherein said top side has a notch extending toward said front wall wherein said notch is configured to accommodate the handle of the paint brush when said cover is positioned in said closed position.

7. The assembly according to claim 6, wherein:

said assembly includes an engagement being coupled to an outer wall of said cup; and said top side has a prominence extending away from a top surface of said top side, said engagement releasably engaging said prominence when cover is positioned in said closed position for retaining said cover in said closed position.

8. The assembly according to claim 7, further comprising:

a tab being coupled to an outer wall of said cup, said tab having a distal edge; and a hinge having a primary end and a secondary end, said primary end being coupled to a lower surface of said lower side of said cover, said secondary end being coupled to a lower surface of said tab on said outer wall of said cup, said hinge being comprised of a deformable material, a distal edge of said lower side of said cover abutting a distal edge of said tab on said outer wall of said cup when said cover is closed.

9. A paint storage assembly for storing liquid paint and for temporarily storing a paint brush to inhibit the paint brush from drying out, said assembly comprising:

a cup for containing liquid paint, said cup having a bottom wall and an outer wall extending upwardly from said bottom wall, said outer wall having an inside surface, an outside surface and a distal end with respect to said bottom wall defining an opening into said cup, said outer wall having a first side and a second side, said first side being planar, said inner surface corresponding to said second side being concavely arcuate with respect to said first side, said outer wall having a lip being disposed on said inner surface, said lip being aligned with said distal end of said outer wall, said lip being rounded with respect to said inner surface, said lip extending around a full perimeter of said distal end, said second side of said outer wall having indicia being applied thereon, said indicia comprising the words "Painting Duo";

a handle being coupled to said cup for carrying said cup, said handle having a first end and a second end, said first end being coupled to said outer surface of said outer wall of said cup, said handle being positioned on said second side of said outer wall at a point located directly opposite said first side of said outer wall, said handle having a bend being positioned closer to said first end than said second end to define a grip portion of said handle being spaced from and extending downwardly along said outer wall of said cup, said grip portion tapering between said bend and said second end;

a clip being coupled to said outer surface of said outer wall of said cup, said clip being positioned on said first side of said outer wall, said clip having a pair of members being spaced apart from each other an appropriate distance to receive a handle of a paint brush thereby attaching the paint brush to said cup;

an engagement being coupled to said outer surface of said outer wall of said cup, said engagement having a distal end with respect to said outer surface, said engagement curving downwardly between said outer wall said distal end of said engagement, said engagement being positioned above said clip on said first side of said outer wall;

a tab being coupled to and extending away from said outer surface of said outer wall of said cup, said tab being positioned on said first side of said outer wall, said tab being spaced from said bottom wall of said cup;

a cover being hingedly disposed on said cup, said cover being positionable in a closed position having said cover enclosing the paint brush when the paint brush is attached to said clip wherein said cover is configured to inhibit the paint brush from drying out, said cover being positionable in an open position having said cover exposing the paint brush when the paint brush is attached to said clip wherein said cover is configured to facilitate the paint brush to be removed from said clip, said cover having a front wall and an exterior wall extending away from said front wall, said exterior wall having a lower side, a top side, a first lateral side and a second lateral side, said cover having a grip extending laterally away from a forward surface of said front wall, said grip being aligned with said top side, said grip having a first portion lying on a plane being oriented coplanar with said top side and a second portion being spaced from and extending downwardly along said front wall thereby facilitating said second portion to be gripped for urging said cover into said open position, said top side having a notch extending toward said front wall wherein said notch is configured to accommodate the handle of the paint brush when said cover is positioned in said closed position, said top side having a prominence extending away from a top surface of said top side, said engagement releasably engaging said prominence when cover is positioned in said closed position for retaining said cover in said closed position;

a hinge having a primary end and a secondary end, said primary end being coupled to a lower surface of said lower side of said cover, said secondary end being coupled to a lower surface of said tab on said outer wall of said cup, said hinge being comprised of a deformable material, a distal edge of said lower side of said cover abutting a distal edge of said tab on said outer wall of said cup when said cover is closed; and a magnet being integrated into said cup thereby facilitating said magnet to magnetically engage a ferrule of the paint brush to temporarily store the paint brush, said magnet being integrated into said inside surface of said outer wall of said cup, said magnet being aligned with said first end of said handle.

* * * * *